US005141123A

United States Patent [19]

Onodera

[11] Patent Number: 5,141,123

[45] Date of Patent: Aug. 25, 1992

[54] ELECTRIC-POWER LID ARRANGEMENT FOR AN ELECTRIC APPARATUS

[75] Inventor: Makoto Onodera, Tokyo, Japan

[73] Assignee: U.S. Philips Corporation, New York, N.Y.

[21] Appl. No.: 722,738

[22] Filed: Jun. 27, 1991

[30] Foreign Application Priority Data

Jul. 19, 1990 [JP] Japan ..... 2-189448

[51] Int. Cl.[5] ..... B65D 43/14; B65D 51/04

[52] U.S. Cl. ..... 220/4.02; 220/340; 220/342

[58] Field of Search ..... 220/4.02, 340, 342, 220/343, 315

[56] References Cited

U.S. PATENT DOCUMENTS

| | | | |
|---|---|---|---|
| 2,533,661 | 12/1950 | Arenberg et al. | 220/340 |
| 2,656,948 | 10/1953 | McGee | 220/343 |
| 4,253,568 | 3/1981 | Long et al. | 220/340 |
| 4,744,487 | 5/1988 | Welborn | 220/342 |
| 4,802,605 | 2/1989 | Salmon et al. | 220/342 |

*Primary Examiner*—Joseph Man-Fu Moy

[57] ABSTRACT

Structure of a power supply lid for an electric apparatus, especially for shaver, has in its housing (1), shaft guide frame (4) which guides shaft (3) slidably, and hook protrusion (5) which protrudes to the direction of battery lid (2), and in its battery lid (2), elastic convex arm (6) provided with opening (8), and pressure contacting surface (9) which guides hook protrusion (5) slidably.

When lid (2) is closed, shaft (3) is set at the backside (i.e. far side from the lid (2)) of frame (4), which means a closed position, and hook protrusion (5) is fixed in opening (8).

When lid (2) is pulled out, shaft (3) is set at the frontside of frame (4), which means a released position, and hook protrusion (5) is released from opening (8), so that the released lid can move slidably along pressure contacting surface (9).

2 Claims, 2 Drawing Sheets

ELECTRIC-POWER LID ARRANGEMENT FOR AN ELECTRIC APPARATUS

Figure 1:
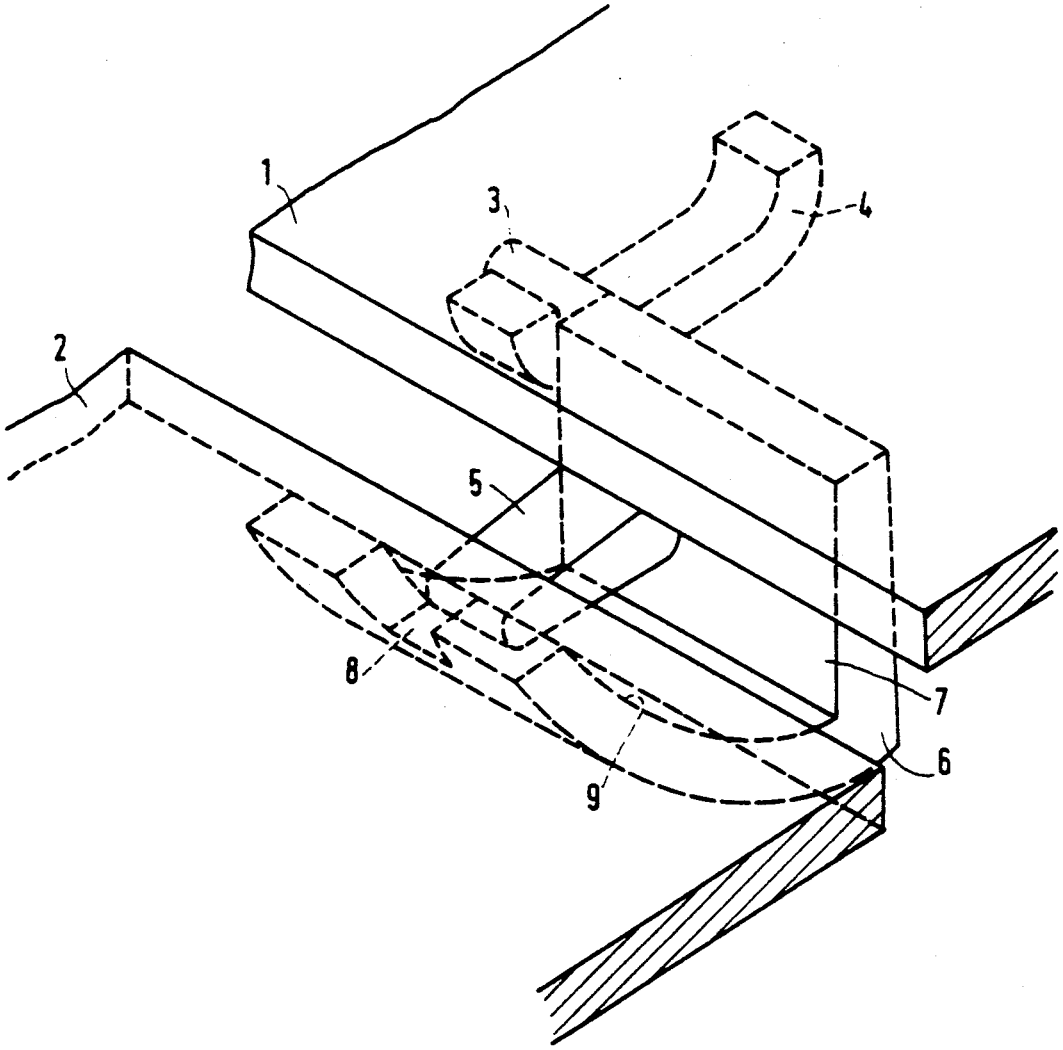

The present invention relates to an electric-power lid arrangement for electric apparatus. More particularly, the present invention relates to a battery lid arrangement for an electric apparatus such as a dry-type shaver, a camera, a portable tape recorder, a flashlight and so on.

Conventional electric-power lid arrangements for electric apparatus include type in which a lid is completely separated from a housing body, like a case arrangement disclosed in Japanese Utility Model Laid-open Publication No. SHO 53-95293, type in which a pivot shaft loaded by a spring is provided at one end of a lid, an engaging projection is provided at the other end of the lid, and a button for engaging with and disengaging from the engaging projection is provided on a housing, like an apparatus disclosed in Japanese Patent Publication No. SHO 59-48110, and type in which a lid has an arm carrying a fixed pivot shaft, like a device disclosed in Japanese Utility Model Laid-open Publication No. SHO 62-127277.

In the above-described detachable lid, there is a fear that, for example, when a user replaces batteries by new ones, he may lose the lid, or may drop it so that the lid is broken. In the case of the aforesaid lid having the spring-loaded pivot shaft, there is no case where the lid is separated from the housing. However, there is the following difficulty. That is, unless the lid is pressed down by a hand, the lid is returned to a closed state. Further, in the case of the aforementioned type disclosed in Japanese Utility Model Laid-open Publication No. SHO 62-127277, there is the following disadvantage. That is, in the case where there is no frictional engagement between the pivot shaft and a bearing portion accommodating therein the pivot shaft, gravity returns the lid to its closed state unless the lid is pressed down by the hand. Furthermore, there are also the following disadvantages. Specifically, a large force is required to move the battery lid to the released position from the closed state, and it is difficult to move the lid to the released position.

Accordingly, it is an object of the invention to provide an electric-power lid arrangement for an electric apparatus, in which a lid is not separated from a battery container, in which an open state of the lid can be stably kept even if the lid is not held by a hand, and in which opening of the lid is easy.

In order to achieve the above object, an electric-power lid arrangement for an electric apparatus with a housing (1) and a lid (2), according to the invention, is characterized in that the housing comprising a pivot shaft guide means (4) for guiding slidably a pivot shaft (3) between a released position where the pivot shaft is drawn out in a direction substantially perpendicular to a pivotal axial direction of the lid to open the lid and a closed position where the pivot shaft is forced into the pivot shaft guide means to close the lid, and an engaging projection (5) protruding in the direction perpendicular to the axis of said pivot shaft from the edge, parallel to said axis of the pivot shaft and situated at the pivot shaft side, of edges of an opening which can be covered by the lid, and the lid (2) having on the edge of the lid parallel to the pivot shaft and situated at the pivot shaft side an elastic curved arm (6) protruding downwardly and outwardly on which the top of the projection (5) can slide frictionally when the lid is moved pivotally, and a pivot shaft support (7) extending upwardly in the shape of hook from the curved arm, wherein the pivot shaft connected on the pivot shaft support is put into the pivot shaft guide means for the pivot shaft in the housing, the elastic curved arm is provided with a slot (8) to which the projection (5) of the housing can be set, and an engaging snap means is arranged between the lid and the housing which closes and locks the lid in the housing when the pivot shaft locates at the closed position.

In a preferred embodiment of the invention, a clicking protuberance is provided near the far end of abutment surface with which the top of the engaging projection in the housing contacts.

With the arrangement of the invention, when the lid is drawn out in the direction perpendicular to the pivot shaft and the engaging snap means is disengaged so that the pivot shaft is moved toward the released position from the closed position along the pivot shaft guide means, the engaging projection gets out of the slot in the elastic curved arm so that the lid can be moved pivotally with respect to the axis of the pivot shaft which is in the released position. At this pivotal movement, the projection is moved pivotally while being in frictional contact with the abutment surface of the elastic curved arm along the abutment surface. By the frictional-contact pivotal movement between the engaging projection of the housing and the abutment surface of the elastic curved arm section of the lid, it is possible to retain or hold the lid at any position. In the case where the clicking protuberance is provided adjacent to the final stroke of the abutment surface, it is possible to further secure that the lid is retained under the maximum open condition.

According to the invention, there can be produced the following advantages. That is, it is possible to hold the lid stably under any open condition without separation of the lid and even while releasing his hand. Further, thd lid is drawn out and can be moved pivotally about the pivot axis at the released position where the lid is drawn out along the pivot shaft guide means in the direction substantially perpendicular to the pivot axis. Accordingly, even if there is an especial protuberance on the side surface of the lid of the electric apparatus, which is opposed to the pivotal direction, the especial protuberance can be cleared to move the lid to the released position. Furthermore, since the lid is into frictional contact with the engaging projection so that the lid can pivotally be moved under a stable condition, the lid can be moved pivotally always under the stable condition without the pivot shaft being moved from the released position within the pivot shaft guide means, making it possible to move pivotally the lid always along a predetermined path. Thus, the pivot shaft is prevented from being moved pivotally to the closed position at the injustice position, making it possible to avoid breakage of the engaging snap means.

Moreover, in the case of a lid of type in which only pivotal movement is done without drawing-out operation, opening operation must be performed under an engaging release button being pushed. This requires complexity of concurrent operation and an excessive force. If the lid is forced to be moved to the released position, there is a fear that the engaging button is broken. In contrast with this, in the case of the invention, disengagement of the engaging snap by which the lid is drawn out and shifted can be done surely and easily. There is no possibility that the engaging snap is broken. Operation of pivotal movement of the lid can easily be done.

A preferred embodiment of the invention will be described below with reference to the accompanying drawings.

Figure 2C:
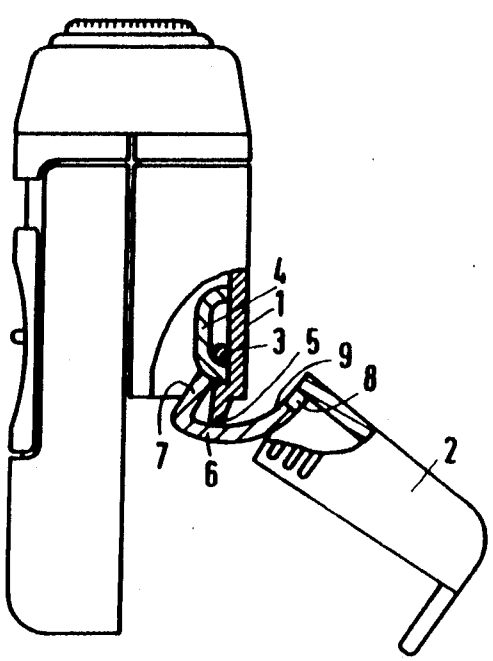
Figure 2B:
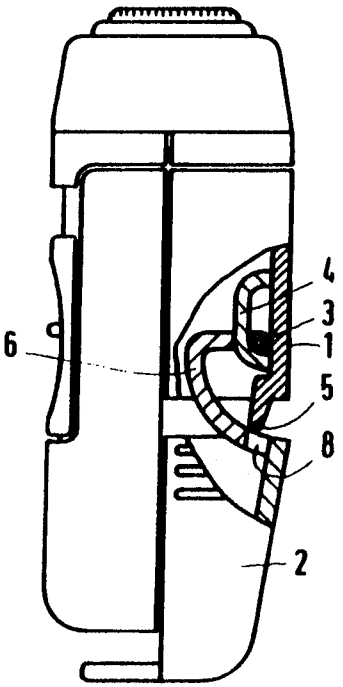
Figure 2A:
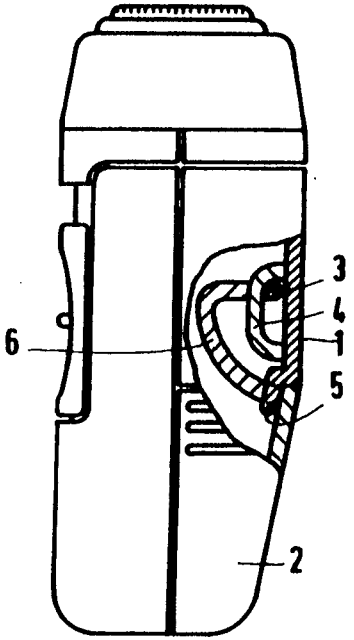

FIG. 1 is a partly-enlarged perspective diagrammatical view of a power supply lid for an electric apparatus according to the invention;

FIGS. 2 (*a*), (*b*) and (*c*) are side elevational view showing each process of opening the shaver lid of the embodiment in which the arrangement of a power supply lid according the invention is applied.

FIG. 1 is a schematic fragmentary enlarged perspective view of a connection between a housing 1 of an electric apparatus and lid 2. Housing 1 is provided with pivot shaft guide frame 4 which serves as pivot shaft guide means for slidably guiding a pivot shaft 3 between a released position where the pivot shaft 3 is drawn out in a direction substantially perpendicular to a pivotal axial direction of the lid to open the latter and a closed position where the aforesaid pivot shaft is forced into the pivot shaft guide frame 4 to close the lid. The pivot shaft guide means may be a pair of grooves formed respectively in protruding walls which are provided on the housing. FIG. 1 shows a condition under which the pivot shaft 3 is in the released position in the pivot shaft guide frame 4. Further, the housing 1 is provided with an engaging projection 5 which projects from an edge of the housing 1 extending in parallel relation to the pivot axis of an opening covered by the lid adjacent to the pivot shaft, in a direction perpendicular to the aforementioned pivot axis.

The lid 2 is provided with an elastic curved arm section 6 and a pivot shaft support 7. The curved arm section 6 is provided at an edge of the lid, which extends in parallel relation to the pivot axis adjacent to the pivot shaft. The curved arm section 6 projects downwardly and outwardly such that a forward end of the projection 5 is slidably and frictionally, contact with the curved arm 6 when the pivot shaft 3 is in the released position and the lid 2 is moved pivotally. The pivot shaft support 7 extends upwardly from the curved arm section 6 like a hook. The pivot shaft 3 is provided on the pivot shaft support 7 so as to project into the pivot shaft guide grooves which are formed respectively by the pivot shaft guide frame 4. Furthermore, the elastic curved arm 6 is provided therein with a slot 8 into which the engaging projection 5 of the housing is fitted.

The lid 2, and the elastic curved arm 6 and the pivot shaft support 7 may be made of plastic material by integral molding. Moreover, the lid 2, and the elastic curved arm section 6 and the pivot shaft support 7 may be formed separately, and may be mounted together by ultrasonic welding.

Such a single hinge arrangement may be provided at a center of the housing wall, or a pair of hinge arrangements may be provided respectively at the left and right of the housing wall. Alternatively, an optional number of hinge arrangements may be provided, if necessary.

Engaging snap means, not shown, for locking the lid 2 to the housing 1 under the closed state while the pivot shaft 3 is at the closed position in the pivot shaft guide frame 4, may be provided at an optional location between the housing 1 and the lid 2. For example, the engaging snap means may be provided between the engaging projection 5 and the slot 8 into which the engaging projection 5 is fitted. Alternatively, the engaging snap means may be provided at any other optional locations.

It is preferably that a clicking protuberance (not shown) is provided on an abutment surface 9 of the elastic curved arm section 6, with which the forward end of the engaging projection 5 on the housing is into sliding frictional contact, preferably, on a location adjacent to a final stroke of opening of the lid 2.

FIG. 2 shows the embodiment of the lid arrangement according to the invention, which is applied to a dry-type shaver serving as the electric apparatus.

FIG. 2(*a*) shows a condition when the lid 2 is closed. At this time, the pivot shaft 3 is in a retreating position in the pivot shaft guide frame 4 of the housing 1, which serve as the pivot shaft guide means. That is, the pivot shaft 3 is in the closed position where the engaging projection 5 of the housing 1 is fitted in the slot 8 in the elastic curved arm section 6 of the lid 2. When the lid 2 is drawn out from this condition in the direction substantially perpendicular to the pivot axis as shown in FIG. 2(*b*), the pivot shaft 3 is in a drawn-out position on the pivot shaft guide frame 4, that is, in the released position. At this time, the engaging projection 5 gets out of the slot 8 in the elastic curved arm section 6 of the lid 2. Subsequently, as shown in FIG. 2(*c*), the lid 2 can be moved pivotally toward the maximum released position while the engaging projection 5 is in frictional contact with the abutment surface 9 of the elastic curved arm section 6. During the pivotal movement, it is ensured that the lid 2 is held or retained under an optional open condition. It is possible to close the lid by reversing the above-described procedure.

The above description is mere description of a preferred embodiment of the invention, and it is of course that various variations or modifications can be made to the invention within the scope of the appended claims.

I claim:

1. An electric-power lid arrangement for an electric apparatus with a housing (1) and a lid (2), the housing comprising a pivot shaft guide means (4) for guiding slidably a pivot shaft (3) between a released position where the pivot shaft is drawn out in a direction substantially perpendicular to a pivotal axial direction of the lid to open the lid and a closed position where the pivot shaft is forced into the pivot shaft guide means to close the lid, and an engaging, projection (5) protruding in the direction perpendicular to the axis of said pivot shaft from the edge, parallel to said axis of the pivot shaft and situated at the pivot shaft side, of edges of an opening which can be covered by the lid, and the lid (2) having on the edge of the lid parallel to the pivot shaft and situated at the pivot shaft side an elastic curved arm (6) protruding downwardly and outwardly on which the top of the projection (5) can slide frictionally when the lid is moved pivotally, and a pivot shaft support (7) extending upwardly in the shape of hook from the curved arm, wherein the pivot shaft connected on the pivot shaft support is put into the pivot shaft guide means for pivot shaft in the housing, the elastic curved arm is provided with a slot (8) to which the projection (5) of the housing can be set, and an engaging snap means is arranged between the lid and the housing which closes and locks the lid in the housing when the pivot shaft locates at the closed position.

2. An electric-power lid arrangement as claimed in claim (1) comprising a clicking protuberance provided near the far end of abutment surface (9) with which the top of the engaging projection in the housing contacts.

* * * * *